United States Patent [19]

Budzich

[11] 4,154,261

[45] May 15, 1979

[54] PRESSURE SENSING PASSAGES OF LOAD RESPONSIVE CONTROL VALVES

[76] Inventor: Tadeusz Budzich, 80 Murwood Dr., Moreland Hills, Ohio 44022

[21] Appl. No.: 813,479

[22] Filed: Jul. 7, 1977

[51] Int. Cl.[2] ..... F15B 13/04

[52] U.S. Cl. ..... 137/596.13; 91/446; 137/596; 251/282

[58] Field of Search ..... 60/451, 452; 137/596, 137/596.13; 91/446, 451; 251/282

[56] References Cited

U.S. PATENT DOCUMENTS

| | | | |
|---|---|---|---|
| 3,881,512 | 5/1975 | Wilke | 137/596.13 |
| 3,951,162 | 4/1976 | Wilke | 137/596.13 X |
| 4,020,867 | 5/1977 | Sumiyoshi | 137/596.13 |

*Primary Examiner*—Gerald A. Michalsky

[57] ABSTRACT

A direction control valve of pressure compensated or load responsive type for use with positive or negative load controllers which maintain a constant pressure differential between selected valve chambers. Controllers are connected to the valve bore by pressure sensing passages which are blocked in the neutral position of the valve spool. Displacement of the valve spool from its neutral position in a sequential manner connects first a valve load chamber to the pressure signal passage and the valve controller and then upon further displacement of the valve spool connects the load chamber with one of the other valve chambers. The sequence of these connections and distance of travel of valve spool to accomplish these connections can be varied.

19 Claims, 5 Drawing Figures

PRESSURE SENSING PASSAGES OF LOAD RESPONSIVE CONTROL VALVES

BACKGROUND OF THE INVENTION

This invention relates generally to pressure compensated or load responsive valves which utilize either positive or negative load controllers. Such valves control positive or negative loads, the displacement of the valve spool from its neutral position being proportional to the flow delivered to the load.

In more particular aspects this invention relates to the synchronization and transmittal of pressure control signals from valve chambers to valve controllers, while those chambers are being interconnected by the valve spool.

It is very desirable to isolate the load chamber of the pressure compensated or load responsive valve from the valve controllers with the valve spool in a neutral position while no work is being performed by hydraulic system. This permits unloading of the pump and avoids leakage losses in the controllers thus increasing system efficiency.

It is also very desirable to transmit to the valve controllers a load pressure signal before flow through the valve begins, so that those controllers can assume their controlling position in anticipation of flow demand.

This function is accomplished by providing a pressure signal passage connecting the valve bore in the region of the partition dividing valve chambers to the valve controller. In the neutral position of the valve spool this pressure signal passage is blocked by a land of valve spool, the initial displacement of valve spool from the neutral position first interconnecting the load chamber with the pressure signal passage and the valve controller and upon further displacement of valve spool, interconnecting the load chamber with either the inlet chamber or the outlet chamber. This method of transmittal of control signals is shown in my U.S. Pat. No. 3,444,689 dated May 20, 1969, my U.S. Pat. No. 3,470,694 dated Oct. 7, 1969, my U.S. Pat. No. 3,744,517 dated July 10, 1973, my U.S. Pat. No. 3,858,393 dated Jan. 7, 1975, my U.S. Pat. No. 3,882,896 dated May 13, 1975, my U.S. Pat. No. 3,998,134 dated Dec. 21, 1976 and U.S. Pat. No. 3,488,953 dated Jan. 13, 1970 issued to Haussler.

However, while this method is very effective in transmitting the load control signal prior to cross connecting valve chambers, it suffers from certain basic disadvantages. Since the drilled pressure signal passage is located in the partition between the valve chambers, in order not to excessively increase the dead band of the valve which is very harmful since it reduces the length of the effective control stroke, the diameter of pressure signal passage must be kept small, resulting in serious attenuation of control signal and high cost of manufacture. Even with a small pressure signal passage the resulting dead band of the valve becomes excessive for some applications.

This method also prevents close synchronization of valve spool timing in control of positive and negative loads.

SUMMARY OF THE INVENTION

It is therefore a principal object of this invention to provide an improved load sensing system for a pressure compensated or load responsive direction control valve, which permits variation in the valve dead band, irrespective of the width of partition between valve chambers and the diameter of load sensing pressure signal passage.

It is another object of this invention to provide a load sensing pressure signal passage of sufficiently large diameter, so it does not attenuate the control signal and is inexpensive in manufacture, while the valve dead band may be reduced.

It is a further object of this invention to provide a load sensing pressure signal passage of sufficiently large diameter so it does not attenuate the control signal, this pressure signal passage extending into one of the valve chambers, while the partition between the valve chambers is not affected by its diameter.

It is a still further object of this invention to provide load sensing system, in which both the synchronization and the sequencing of interconnection between load chamber and load sensing pressure signal passage and interconnection of load chamber with one of the other valve chambers can be selected.

Briefly the foregoing and other additional objects and advantages of this invention are accomplished by providing a novel load sensing system, constructed according to the present invention for use in pressure compensated or load responsive direction control valves. A comparatively large diameter load sensing pressure signal passage is positioned in the partition between valve chambers and communicates valve bore with valve controller. This pressure signal passage is blocked in the neutral position of the valve spool and the valve spool is equipped with circumferential flow transmitting slots, extending into the region of the valve bore adjacent to pressure signal passage. The position of those slots in respect to valve chambers, pressure signal passage, and to each other, determines the synchronization, sequencing and dead band of the valve.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
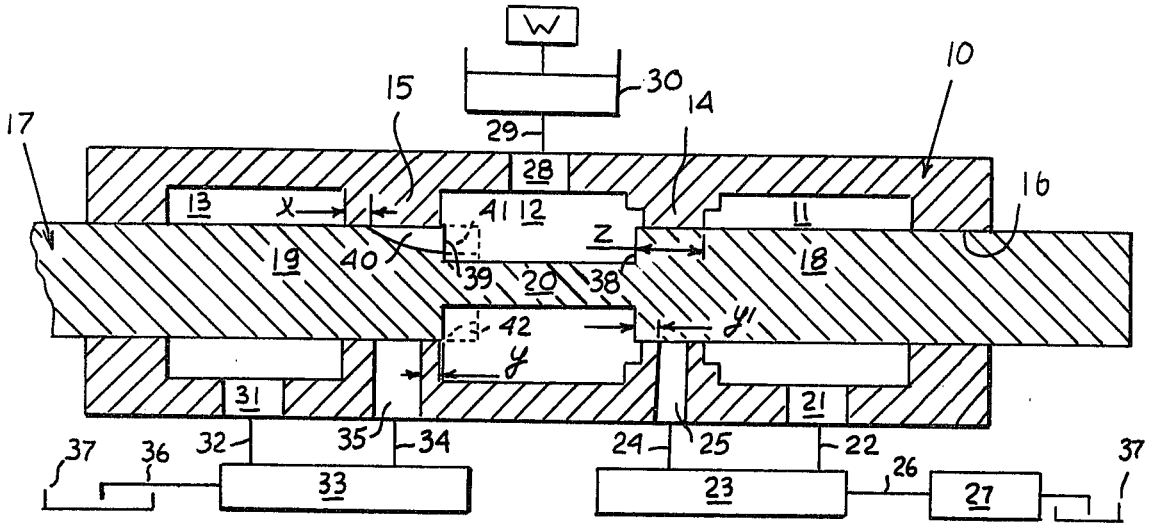
FIG. 1 is a partial longitudinal sectional view of an embodiment of flow control valve showing a conventional load sensing system on the right and one embodiment of load sensing system which is the object of this invention on the left with actuator, lines, valve controllers, pump and reservoir shown diagramatically.

Referring now to the drawings and for the present to FIG. 1, a flow control valve generally designated as 10 has an inlet chamber 11, a load chamber 12 and an outlet chamber 13 separated by partitions 14 and 15. A valve bore 16 passes through the body including partitions 14 and 15 and communicates with inlet chamber 11, load chamber 12 and outlet chamber 13. Valve bore 16 axially guides a valve spool generally designated as 17 which has lands 18 and 19 connected by a stem 20.

Inlet chamber 11 through a port 21 and a fluid conducting line 22 is connected with a control valve 23. Control valve 23 is also connected by a fluid conducting line 24 to a pressure signal passage 25 in flow control valve 10 and by a fluid conducting line 26 with a pump 27. Load chamber 12 is connected through a port 28 and a fluid conducting line 29 with an actuator 30. This right side of the valve represents conventional prior art techniques.

The left said of the valve represents the present invention. Outlet chamber 13 is connected through a port 31 and a fluid conducting line 32 with a control valve 33. Control valve 33 is also connected by a fluid conducting line 34 with an enlarged pressure signal passage 35 and by a fluid conducting line 36 with system reservoir 37. Land 18 of valve spool 17 is provided with a sealing edge 38 and land 19 of valve spool 17 is provided with a sealing edge 39. Flow slots 40 are provided in land 19 which may in some cases have an extension 41, shown in dotted lines. Such an extension may be provided with a sequencing slot 42. A suitable anti-rotational device, not shown, is provided between valve spool 17 and valve bore 16 to prevent relative rotation of the valve spool in relation to the valve bore.

With valve spool 17 in its neutral position, as shown in FIG. 1, land 18 isolates inlet chamber 11 from load chamber 12 and blocks pressure signal passage 25 and land 19 isolates load chamber 12 from outlet chamber 13 and blocks enlarged pressure signal passage 35. Pressure signal passage 25 is of a conventional design and communicates through fluid conducting line 24 with control valve 23, which is of a pressure compensated type and regulates the pressure of pump 27 to maintain pressure in inlet chamber 11 at a pressure level higher, by a constant pressure differential, than pressure in the load chamber 12. Such a control is well known in the art and is described in detail in U.S. Pat. No. 3,448,953 issued to Hausler on Jan. 13, 1970, my U.S. Pat. No. 3,444,689 issued May 20, 1969 and my U.S. Pat. No. 3,470,694 issued Oct. 7, 1969 as mentioned in the Background of the Invention. Such a control, as described in these patents, bypasses the flow from fixed displacement pump, or varies the flow of variable displacement pump in response to pressure signal transmitted from the load chamber 12 through the pressure signal passage 25 and through fluid conducting line 24, to maintain a constant pressure differential between the inlet chamber 11 and the load chamber 12, to maintain the flow through an orifice between these chambers proportional to the area of the orifice, irrespective of the variation in load W. Such an orifice is created by displacement of flow slot 40 in respect to partition 43, see FIG. 2. Enlarged pressure sensing passage 35, communicates through fluid conducting line 34 with control valve 33 which is of a pressure compensated type and maintains a constant pressure differential between load chamber 12 and outlet chamber 13. Such a control is well known in the art and is described in detail in my U.S. Pat. No. 3,744,517 issued July 10, 1973 as mentioned in Background of the Invention. Control valve 33 by throttling regulates flow of the fluid between the load chamber 12 and the outlet chamber 13, see FIG. 1, in response to pressure signal transmitted from the load chamber 12 through the pressure signal passage 35 and through conducting line 34, to maintain a constant pressure differential between these chambers, to maintain the flow through an orifice between these chambers porportional to the area of the orifice, irrespective of the variation in load W. Such an orifice is created by displacement of flow slot 40 in respect to partition 15. Since, as stated above, both control valves 23 and 33 maintain a constant pressure differential between the adjacent chambers, the flow slot 40 and signal passage 35 can be used in partition 14 or partition 15 of FIGS. 1 and 2 providing identical flow characteristics.

Displacement of valve spool 17 from its neutral position to the right, through a distance $y^1$, will connect fluid under pressure in load chamber 12 with pressure signal passage 25, activating the control valve 23, land 18 still isolating load chamber 12 from inlet chamber 11. Movement of valve spool 17 from its neutral position to the right, through a distance Z, will first communicate load chamber 12 with pressure signal passage 25 and then interconnect load chamber 12 with inlet chamber 11, the land 19 isolating load chamber 12 from outlet chamber 13. Distance Z, through which the valve spool 17 must travel to communicate valve chambers, is called valve dead band. This is the conventional prior art technique. A large valve dead band is very detremental to the operation of the valve, since it reduces the effective or controlling stroke of the valve spool and disproportionally increases the valve length. In order to reduce dead band Z the diameter of the pressure signal passage 25 must be kept to a minimum, resulting in a signal passage which will attenuate the control signal and which is expensive to manufacture.

Movement of the valve spool 17 from the right to left (exemplifying this invention), from its neutral position as shown in FIG. 1, through a distance y will connect load chamber 12 with large pressure signal passage 35. Movement of valve spool 17 from its neutral position to the left through distance X will connect load chamber 12 through flow slots 40 to outlet chamber 13, while land 18 isolates load chamber 12 from inlet chamber 11. If distance y is smaller than distance X, movement of valve spool 17 from right to left, through distance X, will first connect load chamber 12 through large signal passage 35 to control valve 33 and then will interconnect load chamber 12 with outlet chamber 13 creating a control flow orifice as described above. If distance y is made equal to distance X, movement of valve spool 17 to the left will simultaneously connect load chamber 12 to large pressure sensing passage 35 and outlet chamber 13. If land 19 is made longer by extension 41, shown in dotted lines, then sequencing groove 42 is provided to obtain the same sequencing and timing of the valve. Distance X constitutes the valve dead band and in the arrangement of land 19, valve dead band is independent of diameter of the large sensing passage 35 and can be selected at any value, for optimum valve performance. Furthermore, diameter of the pressure sensing passage 35 can be made as large as required without increasing the dead band of the valve so that the control signal, transmitted to valve controller, will not be attenuated. Also in this arrangement, by changing the relationship of y to X, sequence of interconnection of valve chambers and activation of the control valves 23 and 33 can be varied, which feature is impossible with the conventional pressure signal passage 25. For purposes of demonstration of the principle of the invention, partitions 14 and 15 are shown approximately equal in width. Also for the same reasons conventional pressure signal passage 25 was shown in communication with control valve 23. By providing large pressure signal passage 35, in place of conventional signal passage 25 and by providing land 18 with flow slots 40, the arrangement of land 19 can be used in control of control valve 23.

Figure 2:
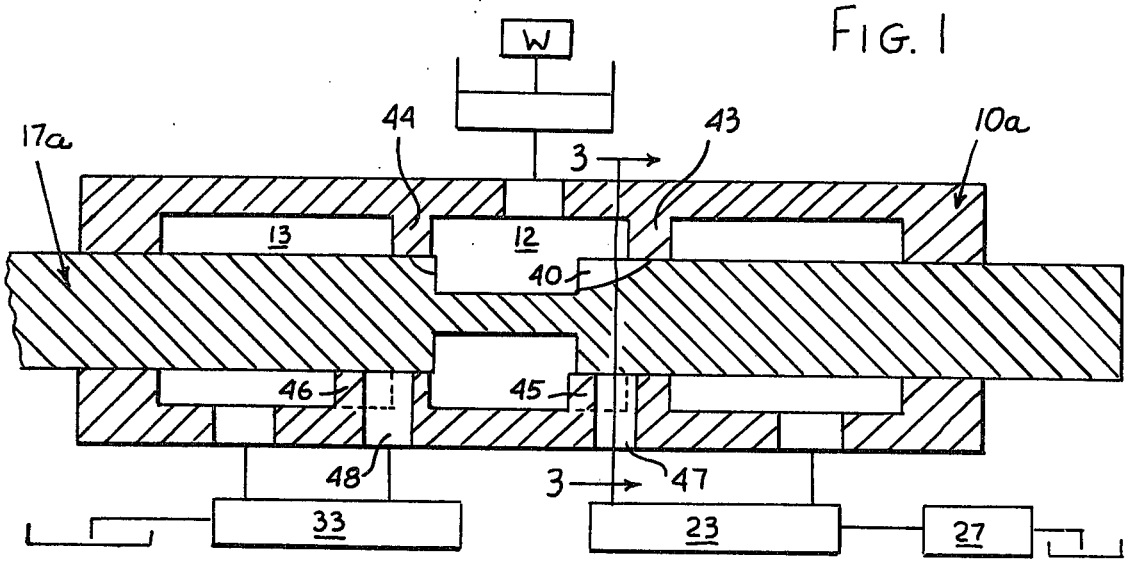
FIG. 2 is a partial longitudinal sectional view of a flow control valve embodiment, essentially that of FIG. 1, showing two additional embodiments of load sensing system which are the object of this invention with actuator, lines, valve controllers, pump and reservoir shown diagramatically.
Figure 3:
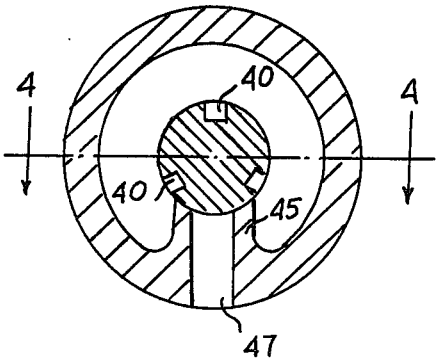
FIG. 3 is a sectional view taken substantially along the plane designated by line 3—3 of FIG. 2.
Figure 4:
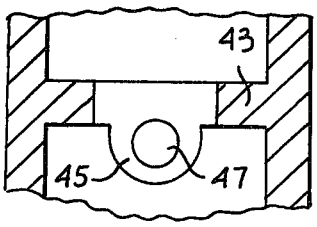
FIG. 4 is a partial sectional view taken substantially along the plane designated by line 4—4 of FIG. 3 but with valve spool removed and showing detail of the valve bore.

Referring now to FIG. 2 two different embodiments of the present invention are shown one on each side of the valve 10*a*. Large pressure signal passages 35 of FIG. 1 result in wide partition 15 which in turn results in increase in length of valve housing and wider spacing of load chamber 12 and outlet chamber 13 which has disadvantages of increased length of the valve, increased cost and decreased maximum area of flow in respect to the movement of the valve spool. Partitions 43 and 44 of flow control valve 10*a* of FIG. 2 are made locally wider by extensions 45 and 46, to accomodate large signal passages 47 and 48 while the width of partitions 43 and 44 separating valve chambers remain narrow. Extension 45 of partition 43 which extends into load chamber 12 is shown in detail in FIG. 3, which is a section through FIG. 2 along the plane designated by line 3—3. Further details of extension 45 are shown in FIG. 4, which is a section through FIG. 3 along the plane designated by line 4—4 with valve spool removed. As shown in FIG. 4 pressure signal passage 47 projects into load chamber 12 and is sealed by the bore surface of the extension 45 which might be semi-circular in form. The extension 46 projects into outlet chamber 13 and can be made identical to extension 45, as illustrated in FIGS. 3 and 4. Extension 45, projecting into load chamber 12, utilizes the same arrangement of flow slots 40 on valve spool 17*a* as those shown in FIG. 1. Extension 46, projecting into outlet chamber 13, utilizes similar slots for interconnecting load chamber 12 with chamber 13 while pressure signal passage 48 is connected with the load chamber 12. Although the basic sequencing of the valves of FIGS. 1 and 2 is similar for the same valve displacement, much larger areas of flow can be obtained between load chamber 12 and outlet chamber 13, outlet chamber 13 and inlet chamber 11 being closely located in respect to each other, the width of the partitions 44 and 43 being independent of the diameter of the pressure signal passages 48 and 47.

Figure 5:
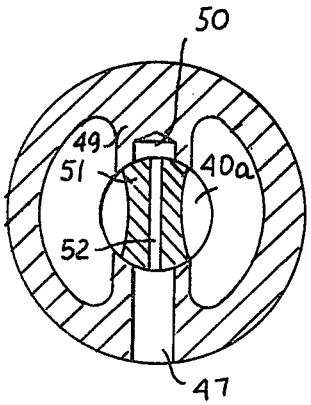
FIG. 5 is a sectional view similar to that of FIG. 3 but showing a method of balancing of valve spool.

The valve arrangement, shown in FIG. 5, is similar to that shown in FIG. 3. However, extension 49 similar in area and shape to the extension 45, has been added to partition 43, diametrically opposite to extension 45 for balancing of the transverse forces generated on valve spool 17*a* by the pressure existing in the pressure signal passage 47. The pressure signal passage 47 is provided with an extension 50 projecting into the opposite surface of the valve bore and pressure from pressure signal passage 47 is conducted by passage 52 in the valve spool 17*a* to the extension 50. Therefore transverse forces developed on the valve spool 17*a* by the pressure in pressure signal passage 47 and extension 50 balance each other reducing the friction forces of valve spool 17*a*.

Although preferred embodiments of this invention have been shown and described in detail it is recognized that the invention is not limited to the precise forms and structure shown and various modifications and rearrangements as will readily occur to those skilled in the art upon full comprehension of this invention may be resorted to without departing from the scope of the invention as defined in the claims.

What is claimed is:

1. A valve assembly comprising a housing having a fluid load chamber and two other chambers, said two other chambers being a fluid inlet chamber and a fluid outlet chamber, partitions separating said chambers and having extension means projecting into said chambers, valve bore means extending through said partitions and in direct communication with all of said chambers, differential pressure control valve means operable to maintain a constant pressure differential between adjacent chambers, an opening on the surface of said valve bore means passing through extension means of one of said partitions adjacent to said load chamber, pressure signal passage means connecting said differential pressure control valve means to said opening, said opening having a width parallel to axis of said valve bore means, said valve bore means axially guiding a valve spool having land means, said valve spool having a neutral position in which said land means isolate said chambers and block said opening to said pressure signal passage means, and sequencing means on said valve spool to determine a first actuating distance in one direction from neutral position of said valve spool to interconnect said load chamber with said pressure signal passage means, synchronizing means on said valve spool to determine a second actuating distance in the same direction from neutral position of said valve spool to interconnect said load chamber and said pressure signal passage means with one of said other chambers, whereby said first and second actuating distance can be selected with respect to each other in a manner independent of width of said opening to determine the dead band of the valve assembly.

2. A valve assembly as set forth in claim 1 wherein said valve spool has synchronizing means and sequencing means, said valve spool when displaced from its neutral position first interconnecting through said sequencing means said load chamber with said pressure signal passage means, further displacement of said valve spool from its neutral position interconnecting through said synchronizing means said load chamber with one of said other chambers.

3. A valve assembly as set forth in claim 2 wherein said sequencing means and said synchronizing means when displaced from neutral position interconnect simultaneously said load chamber with said pressure signal passage means and one of said other load chambers.

4. A valve assembly as set forth in claim 2 wherein said valve spool has first and second synchronizing means, first and second sequencing means and first and second pressure signal passage means, said valve spool when displaced from its neutral position in one direction first interconnecting through said first sequencing means said load chamber with said first pressure signal passage means, further displacement of said valve spool interconnecting through said first synchronizing means said load chamber with said inlet chamber, said valve spool when displaced from its neutral position in opposite direction first interconnecting through said second sequencing means said second pressure signal passage means and then interconnecting through said second synchronizing means said load chamber with said outlet chamber.

5. A valve assembly as set forth in claim 4 wherein a first opening of said first pressure signal passage means is located on the surface of said valve bore in the region of said partition means separating said load chamber from said inlet chamber and a second opening of said second pressure signal passage means is located on the surface of said valve bore in the region of said partition means separating said load chamber from said outlet chamber.

6. A valve assembly as set forth in claim 1 wherein said synchronizing means has circumferentially spaced groove means in said land means of said valve spool, said opening of said pressure signal passage means being located between said circumferentially spaced groove means.

7. A valve assembly as set forth in claim 1 wherein said sequencing means is regulated by position of annular groove means on said valve spool.

8. A valve assembly as set forth in claim 1 wherein said sequencing means has slot means on said valve spool land means in a plane passing through the centerline of said valve bore and the center of said opening of said pressure signal passage means.

9. A valve assembly as set forth in claim 1 wherein said opening of said pressure signal passage means is located on the surface of said valve bore in the region of said partition means separating said load chamber from said inlet chamber.

10. A valve assembly as set forth in claim 1 wherein said opening of said pressure signal passage means is located on the surface of said valve bore in the region of said partition means separating said load chamber from said outlet chamber.

11. A valve assembly as set forth in claim 1 wherein said partition means has extension means into said load chamber locally extending said valve bore surface for sealing of said opening of said pressure signal passage means.

12. A valve assembly as set forth in claim 1 wherein said extension means of said partition means extends into said inlet chamber locally extending said valve bore surface for sealing of said opening of said pressure signal passage means.

13. A valve assembly as set forth in claim 1 wherein said extension means of said partition means extends into said outlet chamber locally extending said bore surface for sealing of said opening of said pressure signal passage means.

14. A valve assembly as set forth in claim 1 wherein balancing surface means is provided on surface of said valve bore diametrically opposite to said opening of said pressure signal passage means.

15. A valve assembly as set forth in claim 1 wherein said opening of said pressure signal passage extends into the diametrically opposite surface of said valve bore.

16. A valve assembly as set forth in claim 15 wherein passage means through said land of said valve spool communicates said opening of said pressure signal passage means with said balancing surface means.

17. A valve assembly as set forth in claim 1 wherein said opening of said pressure signal passage means is circular.

18. A valve assembly as set forth in claim 1 wherein said valve means has means responsive to pressure differential between said inlet chamber and said load chamber.

19. A valve assembly as set forth in claim 1 wherein said valve means has means responsive to pressure differential between said load chamber and said outlet chamber.

* * * * *